United States Patent [19]

Enga et al.

[11] 4,389,983

[45] Jun. 28, 1983

[54] PRECHAMBER CATALYTIC IGNITION SYSTEM

[75] Inventors: Bernard E. Enga, Maidenhead; Christopher Prasad, Sonning Common, Near Reading, both of England

[73] Assignee: Johnson, Matthey & Co., Limited, London, England

[21] Appl. No.: 330,590

[22] Filed: Dec. 14, 1981

Related U.S. Application Data

[63] Continuation of Ser. No. 109,907, Jan. 7, 1980, abandoned.

[30] Foreign Application Priority Data

Jan. 10, 1979 [GB] United Kingdom ..... 7900874

[51] Int. Cl.[3] ..... F02B 75/12; F02B 23/00; F02P 1/00

[52] U.S. Cl. ..... 123/143 B; 123/670; 123/143 A; 123/254

[58] Field of Search ..... 123/143 B, 143 A, 670, 123/254

[56] References Cited

U.S. PATENT DOCUMENTS

| | | | |
|---|---|---|---|
| Re. 30,426 | 11/1980 | Haslett | 123/143 B |
| 1,750,570 | 3/1930 | Charlton | 123/143 B |
| 2,978,360 | 4/1961 | Bradstreet et al. | 123/670 |
| 3,648,676 | 3/1972 | Lowman, Jr. | 123/670 |
| 3,923,011 | 12/1975 | Pfefferle | 123/143 B |
| 4,011,839 | 3/1977 | Pfefferle | 123/143 B |
| 4,041,922 | 8/1977 | Abe et al. | 123/143 B |
| 4,092,967 | 6/1978 | Haslett | 123/143 B |
| 4,185,593 | 1/1980 | McClure | 123/670 |

FOREIGN PATENT DOCUMENTS

| | | | |
|---|---|---|---|
| 2730882 | 1/1979 | Fed. Rep. of Germany | 123/143 A |

*Primary Examiner*—Raymond A. Nelli

*Attorney, Agent, or Firm*—Cushman, Darby & Cushman

[57] ABSTRACT

This invention relates to internal combustion engines and particularly to igniting the fuel/air mixture of the engine. In more detail a catalytic engine comprises one or more cylinders, each cylinder having an associated piston and an entry port disposed at the top or in the region of the top of the cylinder and leading into a passage in communication with a precombustion chamber, means for injecting fuel into the combustion chamber, and a catalytic unit disposed across the entry port or across the said passage for catalytically igniting an injected fuel/air mixture, the catalytic unit including a thermally stable and oxidation resistant member having a multiplicity of flow paths or channels, the surfaces of which possess catalytic activity.

15 Claims, 5 Drawing Figures

PRECHAMBER CATALYTIC IGNITION SYSTEM

This is a continuation of application Ser. No. 109,907 filed Jan. 7, 1980, now abandoned.

This invention relates to internal combustion engines. More particularly the invention relates to the ignition of fuel which takes place in the combustion chamber, to improving the efficiency of an internal combustion engine and to reducing pollutants in the engine exhaust.

An object of the present invention is to produce an internal combustion engine in which a major proportion of the fuel undergoes catalytic combustion within the confines of a combustion chamber having a volume of similar order to that of currently used internal combustion engines.

In U.S. Pat. No. 4,092,967 (Haslett dated 6th June, 1978) there is described an internal combustion engine in which the major part of the combustion chamber of each cylinder is afforded by a recess formed in the piston crown, and a catalytic element of mesh, grid, perforated or sintered or other construction is carried by the piston in a position at least partly overlying the said recess. The fuel is injected into the said recess to contact and pass through the catalytic element and ignition is effected by its contact with the catalytic element. Throughout this specification and claims this engine is sinply referred to as a catalytic engine.

The present invention is a modified and improved version of a catalytic engine of the type described.

SUMMARY OF THE INVENTION

According to the present invention a catalytic engine for producing power by the combustion of fuel comprises one or more cylinders, each cylinder having an associated piston and an entry port disposed at the top or in the region of the top of the cylinder and leading into a passage in communication with a precombustion chamber, means for injecting fuel into the precombustion chamber, a catalytic unit disposed across the entry port or across the said passage for catalytically igniting an injected fuel/air mixture, the catalytic unit including a thermally stable and oxidation resistant member having a multiplicity of flow paths or channels, the surfaces of which possess catalytic activity. In a preferred embodiment of the invention the paths or channels in the catalyst monolith serve to produce a pressure drop of the gas/fuel of not more than 10%.

Conveniently, the fuel is injected into the precombustion chamber by means of a fuel injector which directs a stream of liquid fuel onto one or more baffle surfaces at sufficient velocity to produce a finely divided liquid in droplet form.

The catalytic engine according to the present invention can be operated on the stratified charge principle and the catalyst unit is placed in the region of the mouth of the precombustion chamber rather than in the piston crown. Preferably, the fuel injector with or without baffles as mentioned previously is also placed inside the precombustion chamber. Where the engine is operated on the stratified charge principle, the catalytic unit is preferably disposed above the mouth or entry port of the precombustion chamber.

Alternative positions may be employed for the catalyst unit or more than one unit may be employed. For example the unit may be at the top of the recess formed in the piston crown and fuel from the injector or baffled injector is injected therethrough. Or it may be at the bottom of the recess forming the major part of the combustion chamber. Alternatively two separate units may be employed one at each position, top and bottom. Intermediate positions may also be used.

The invention also includes a process for the production of power by combustion of a fuel in an engine according to the invention. It also includes power when produced by an engine according to the invention.

DETAILED DESCRIPTION OF THE INVENTION

In a preferred embodiment of the engine according to the invention, a separate fuel injector or injectors are used in each individual precombustion chamber.

The catalyst unit may be in the form of a metallic honeycomb but may also be in the form of an interwoven wire gauze or mesh or a corrugated sheet or foil.

The combustion commenced in contact with the honeycomb continues and consumes virtually all of the remainder of the uncombusted fuel in the combustion chamber.

Preferably the metallic honeycomb is formed from one or more metals selected from the group comprising Ru, Rh, Pd, Ir and Pt. However, base metals may be used or base metal alloys which also contain a platinum group metal component may be used.

The walls of the metallic honeycomb preferably have a thickness within the range 2–4 thousandths of one inch. The preferred characteristics of the metallic honeycomb having catalyst deposited thereon are (i) that it presents low resistance to the passage of gases by virtue of its possession of a high ratio of open area to blocked area and (ii) that it has a high surface to volume ratio.

A typical 400 cells per square inch metallic honeycomb of the present invention has walls 0.002 inch thick, a 91–92% open area and a 4% pressure drop. A 200 cell per square inch metallic honeycomb still has a 95% open area and a pressure drop of 4% or less.

Suitable platinum group metals for use in fabrication of the metallic honeycomb are platinum, 10% rhodium-platinum and dispersion strengthened platinum group metals and alloys as described in British Pat. Nos. 1280815 and 1340076 and U.S. Pat. Nos. 3689987, 3696502 and 3709667.

Suitable base metals which may be used are those capable of withstanding rigorous oxidising conditions. Examples of such base metal alloys are nickel and chromium alloys having an aggregate Ni plus Cr content greater than 20% by weight and alloys of iron including at least one of the elements chromium (3–40) wt.%, aluminium (1–10) wt. %, cobalt (trace-5) wt.%. Such substrates are described in German DOS No. 2340664.

Other examples of base metal alloys capable of withstanding the rigorous conditions required are iron-aluminium-chromium alloys which may also contain yttrium. The latter alloys may contain 0.5–12 wt.% Al, 0.1–0.3 wt.% Y, 0–20 wt.% Cr and balance Fe. These are described in U.S. Pat. No. 3298826. Another range or Fe-Cr-Al-Y alloys contain 0.5–4 wt.% Al, 0.5–3.0 wt.% Y, 20.0–95.0 wt.% Cr and balance Fe and these are described in U.S. Pat. No. 3027252.

Examples of alloys we have found to be useful are Iconel 600 and 601. The Nimonic alloys, Incoloy 800 and the Nichrome alloys (Registered Trade Marks), stainless steels clad with platinum group metals may also be used.

Base metal alloys which also contain a platinum group metal component are useful as a catalytic metallic honeycomb in very fierce oxidising conditions, for example in catalysis of the combustion in gas turbine engines. Such alloys are described in U.S. Pat. No. 4061495 and in German DOS No. 2530245 and contain at least 40 wt.% Ni or at least 40 wt.% Co, a trace to 30 wt.% Cr and a trace to 15 wt.% of one or more of the metals Pt, Pd, Rh, Ir, Os and Ru. The alloys may also contain from a trace to the percentage specified of any one or more of the following elements:

| | % by weight |
|---|---|
| Co | 25 |
| Ti | 6 |
| Al | 7 |
| W | 20 |
| Mo | 20 |
| Hf | 2 |
| Mn | 2 |
| Si | 1.5 |
| V | 2.0 |
| Nb | 5 |
| B | 0.15 |
| C | 0.15 |
| Ta | 10 |
| Zr | 3 |
| Fe | 20 |
| Th and rare earth metals or oxides | 3 |

Where the metallic substrate is composed either substantially or solely of platinum group metal it may be in the form of an interwoven wire gauze or mesh or corrugated sheet or foil. These types of base metal substrates are also described in British Pat. No. 1492929 and German DOS No. 2450664 and they may be used in engines according to the present invention. Such base metal substrates may have deposited thereon a first layer comprising an oxygen containing coating and a second and catalytic layer. The oxygen containing coating is usually present as an oxide selected from the group consisting of alumina, silica, titania, zirconia, hafnia, thoria, beryllia, magnesia, calcium oxide, strontium oxide, barium oxide, chromia, boria, scandium oxide, yttrium oxide, and oxides of the lanthanides. Alternatively, the oxygen in the first layer may be present as an oxygen containing anion selected from the group consisting of chromate, phosphate silicate and nitrate. The second catalytic layer may, for example, comprise a metal selected from the group consisting of Ru, Rh, Pd, Ir, Au, Ag, an alloy containing at least one of the said metals and alloys containing at least one of the said metals and a base metal. The first and second layers may be deposited or otherwise applied to the substrate as described in British Pat. No. 1492929 and German DOS No. 2450664.

Alternative catalytic units are the structures defined in U.S. Pat. No. 4,233,185.

In British patent application No. 51219/76 there is described a catalyst comprising a metallic substrate having deposited thereon a surface coating consisting of one or more intermetallic compounds of the general formula $A_xB_y$ where A is selected from the group consisting of Ru, Rh, Pd, Ir and Pt and B is selected from the group consisting of Al, Sc, y, the lanthanides, Ti, Zr, Hf, V, Nb, and Ta and x and y are integral and may have values of 1 or more.

In British patent application No. 51219/76 the surface coating of intermetallic compound is, preferably, in the form of a thin film ranging in thickness from 2 to 15 microns.

Many compounds of the type $A_xB_y$ are miscible with one another and structures in which the surface coatings deposited upon the said metallic substrate contains more than one compound of the type $A_xB_y$ are within the scope of this invention.

When the intermetallic compound is deposited in the form of a coating not more than 15 microns thick upon the surface of a metallic substrate, excessive brittleness is absent and the coated substrate may be handled normally.

A number of different techniques may be employed to produce a coating in the form of a thin film of intermetallic compound upon the surface of the metal metallic substrate. For example, aluminium may be deposited onto the surface of rhodium-platinum gauzes by a pack-aluminising process. In this process the gauzes are packed into a heat-resistant container in an appropriate mixture of chemicals such that aluminium is transferred via the vapour phase to the gauze surface. At the aluminising temperature, typically 800°-900° C., interaction between the platinum and aluminium occurs to to give the required intermetallic compound.

Alternatively, chemical vapour deposition from $ZrCl_4$ can be used to form a layer of $Pt_3Zr$, or electrodeposition may be used either from aqueous or fused salt electrolysis to give the requisite compound.

Whichever method is adopted the objective is to form a layer of a firmly adherent, intermetallic compound on the wires of the gauze pack or other substrate.

In another technique, the metals forming the intermetallic compound are prepared as an appropriate solution in water or an organic solvent. The compound is caused to deposit upon the metallic substrate or gauze by the addition of reducing agent. The metallic substrate is placed in the solution whilst the precipitation is taking place and becomes coated with a uniform, microcrystalline layer of the intermetallic compound.

BRIEF DESCRIPTION OF THE DRAWINGS

The invention will now be described by way of example with reference to the accompanying drawings in which.

DETAILED DESCRIPTION OF THE DRAWINGS

Figure 1:
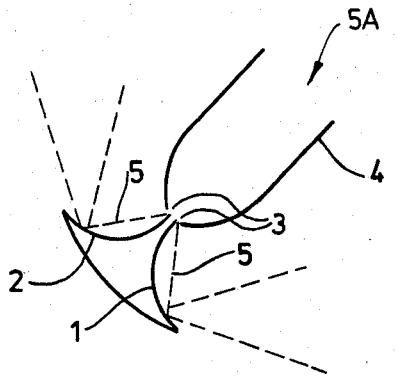
FIG. 1 is a diagrammatic view of a baffled fuel injector used in catalytic engines according to the invention and FIGS. 2, 3, 4 and 5 are diagrammatic sectional views of four embodiments of piston-cylinder-precombustion-catalytic unit arrangements of a catalytic engine according to the invention.
Figure 2:
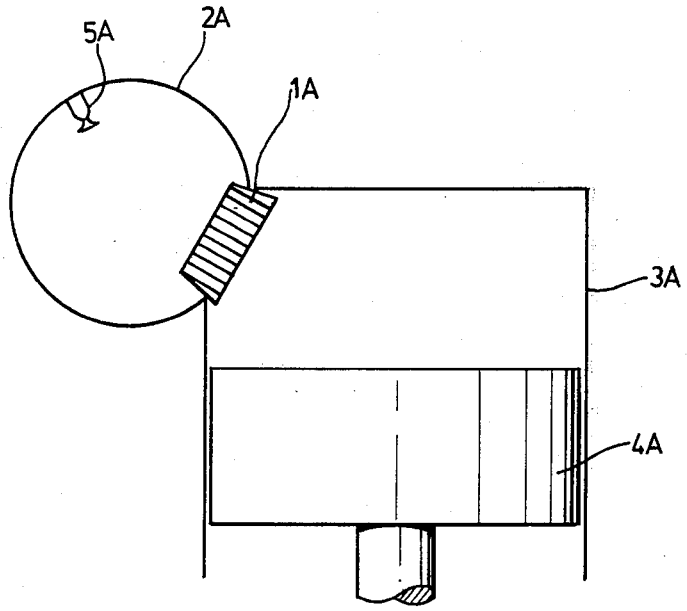
Figure 3:
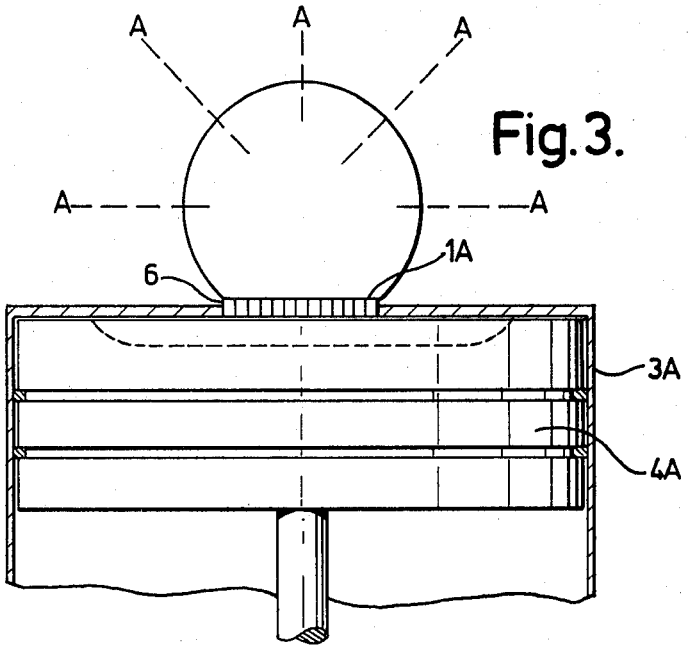
Figure 4:
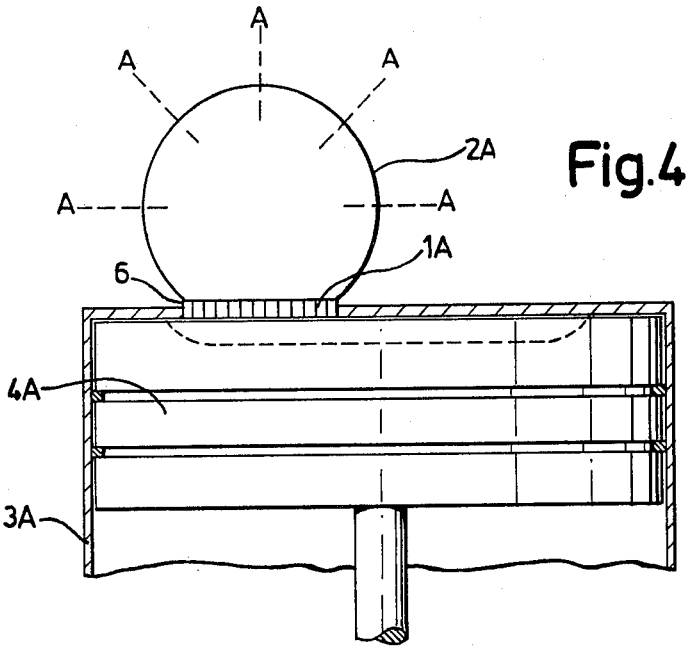

In the drawings the same reference numbers have been used for identical components.

Refering to FIG. 1, the baffled fuel injector 5A has a tubular body 4 terminating in a curved conical end portion which houses a ring of injector nozzles 3 having a diameter between 0.002 and 0.02 inch. Attached to the injector body or formed integrally therewith is a baffle which consists of two separate curved baffle surfaces 1 and 2. Alternatively, the baffle surfaces may be in the form of a curved divergent and conical surface or revolution. In operation, fuel is forced, under pressure via the tubular body 4 and nozzles 3 to form a plurality of streams which impinge upon the baffles where dropletization occurs.

In FIGS. 2, 3, 4 and 5, piston 4A, cylinder 3A and precombustion chamber 2A arrangements are shown with a catalytic unit 1A disposed in a port 6 between the precombustion chamber 2A and the cylinder 3A. The fuel injector 5A (FIG. 1) may be located at any of the positions designated A in FIGS. 3, 4 and 5. Full details regarding the catalytic unit 1A, its construction and the materials from which it may be made have been given earlier in this specification and will not be repeated.

If desired, the precombustion chamber and the cylinder may be interconnected by a short passage (not shown), in the form of an extension of the port 6. Further, the passage may be formed within a so-called hot plug (used as an aid in cold-starting) in which case the catalyst unit is housed at the port 6 or across the passage but not within the precombustion chamber 2A per se.

Figure 5:
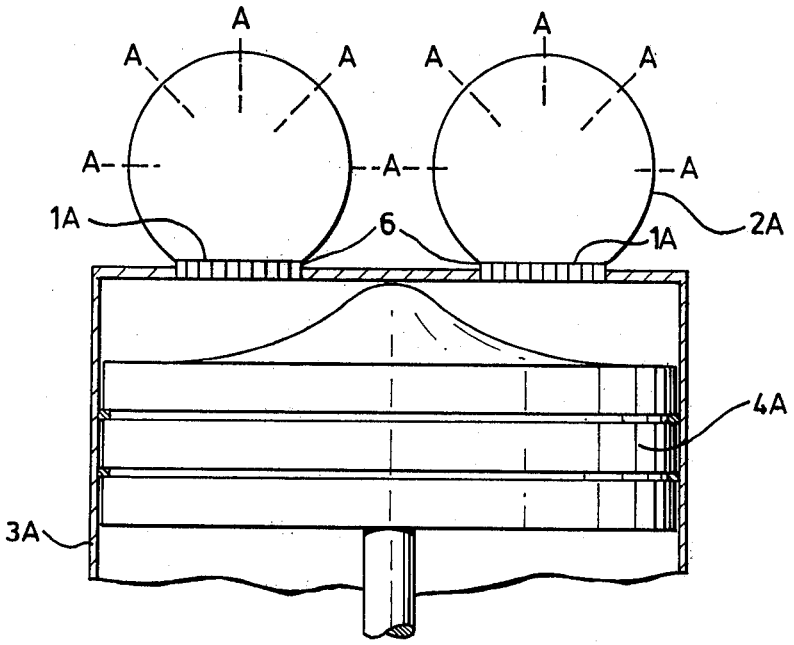

In FIG. 5, two precombustion chambers are shown situated on each side of a piston bearing a raised piston crown.

We claim:

1. A catalytic engine for producing power by the combustion of fuel comprising at least one cylinder, each cylinder having an associated piston and a port disposed near the top of the cylinder and in communication with a precombustion chamber which is located outside the cylinder, a fuel injector located in the precombustion chamber for injecting fuel into the precombustion chamber at a point spaced from said port, and a catalytic unit disposed in and across the port for catalytically igniting the resulting injected fuel/air mixture to thereby operate said piston, the catalytic unit including a thermally stable and oxidation resistant member having a multiplicity of flow paths, the surfaces of which possess catalytic activity.

2. An engine according to claim 1 wherein the thermally stable and oxidation resistant member is in the form of a metallic honeycomb, woven wire gauze, mesh, or corrugated foil.

3. An engine according to claim 2 wherein the said member is made from at least one of the metals Ru, Rh, Pd, Ir and Pt and alloys containing at least one of the said metals.

4. An engine according to claim 2 wherein the said member is made from at least one of the metals Ru, Rh, Pd, Ir and one or more base metals.

5. An engine according to claim 4 wherein the said base metal is selected from the group nickel and chromium.

6. An engine according to claim 2 wherein the said member is made from an alloy of nickel and chromium having an aggregate nickel plus chromium content greater than 20 wt.%.

7. An engine according to claim 2 wherein the said member is made from an alloy of iron including at least one of the elements chromium (3–40) wt.%, aluminium (1–10) wt.%, cobalt (trace-5) wt.%, nickel (trace-72) wt.% and carbon (trace-0.5) wt.%.

8. An engine according to claim 2 wherein the said member is made from an alloy which contains 0.5–12 wt.% Al, 0.1–3.0 wt.% Y, 0–10 wt.% Cr and the balance, Fe.

9. An engine according to claim 6 wherein the said alloy is stainless steel clad with a layer of Ru, Rh, Pd, Ir and Pt or alloys containing at least one of the said metals.

10. An engine according to claim 6 wherein the said alloy contains at least 40 wt.% Ni or at least 40 wt.% Co, a trace to 30 wt.% Cr and a trace to 15 wt.% of one or more of the metals Pt, Pd, Rh, Ir, Os and Ru. contains at least 40 wt.% Ni or at least 40 wt.% Co, a trace to 30 wt.% Cr and a trace to 15 wt.% of one or more of the metals Pt, Pd, Rh, Ir, Os and Ru.

11. An engine according to claim 10 wherein the alloy also contains from a trace to the percentage specified of at least one of the following elements:

| | % by weight |
|---|---|
| Co | 25 |
| Ti | 6 |
| Al | 7 |
| W | 20 |
| Mo | 20 |
| Hf | 2 |
| Mn | 2 |
| Si | 1.5 |
| V | 2.0 |
| Nb | 5 |
| B | 0.15 |
| C | 0.05 |
| Ta | 10 |
| Zr | 3 |
| Fe | 20 |
| Th and rare earth metals and oxides | 3 |

12. An engine according to anyone of claims 6,7,8,9 or 11 wherein the said alloy has applied thereto a first layer of an oxygen containing coating and a second and catalytic layer.

13. An engine according to claim 12 wherein the catalytic layer is selected from the group consisting of Ru, Rh, Pd, Ir, Pt, Au and Ag.

14. An engine according to claim 12, wherein the catalytic layer is an intermetallic compound having the general formula $A_xB_y$ where A is selected from the group consisting of Al, Sc, Y, the lanthanides, Ti, Zr, Hf, V, Nb, and Ta and x and y are integral and may have values of 1 or more.

15. An engine according to claim 18 wherein the means for injecting fuel into the precombustion chamber comprises an injector having at least one injection nozzle and a baffle whereby fuel ejected through the nozzle impinges upon the baffle to produce fuel in droplet form.

* * * * *